US007878502B2

(12) United States Patent
Slemer Dos Santos et al.

(10) Patent No.: US 7,878,502 B2
(45) Date of Patent: Feb. 1, 2011

(54) SLOWING DEVICE FOR A MACHINE FOR WORKING ELEMENTS IN SHEETS

(75) Inventors: Vitor A. Slemer Dos Santos, Sao Paulo (BR); Patrice Chatry, Lugrin (FR)

(73) Assignee: Bobst S.A (CH)

( * ) Notice: Subject to any disclaimer, the term of this patent is extended or adjusted under 35 U.S.C. 154(b) by 137 days.

(21) Appl. No.: 12/413,966

(22) Filed: Mar. 30, 2009

(65) Prior Publication Data

US 2009/0243197 A1 Oct. 1, 2009

(30) Foreign Application Priority Data

Apr. 1, 2008 (EP) ..... 08006664

(51) Int. Cl.
*B65H 29/68* (2006.01)

(52) U.S. Cl. ..... 271/182

(58) Field of Classification Search ..... 271/182
See application file for complete search history.

(56) References Cited

U.S. PATENT DOCUMENTS 2,566,240 A * 8/1951 Mursch ..... 271/182
5,599,012 A * 2/1997 Rebeaud ..... 271/182
6,296,029 B1 * 10/2001 Grivna ..... 198/782
6,588,582 B2 * 7/2003 Rebeaud ..... 271/182
2001/0040085 A1 11/2001 Rebeaud
2005/0092867 A1 * 5/2005 Casella et al. ..... 242/899

FOREIGN PATENT DOCUMENTS

CH 689 977 2/2000
EP 1 153 869 11/2001

* cited by examiner

*Primary Examiner*—Stefanos Karmis
*Assistant Examiner*—Gerald W McClain
(74) *Attorney, Agent, or Firm*—Ostrolenk Faber LLP

(57) ABSTRACT

A slowing device includes a flexible slowing member that extends transversely to the trajectory of sheets being fed. The member is movable between at least two limit positions, one in which its trajectory encounters that of the sheets, the other in which the slowing member is moved aside from the trajectory of the sheets. A drive device moves the slowing member between its limit positions. The drive device for the slowing member includes a pneumatic actuator which acts on a linear cam that pivots about a transverse shaft. A roller rolls along the surface of the linear cam. The roller and the slowing member are supported by a support that pivots about a transverse shaft.

3 Claims, 4 Drawing Sheets

SLOWING DEVICE FOR A MACHINE FOR WORKING ELEMENTS IN SHEETS

BACKGROUND OF THE INVENTION

The present invention relates to a slowing device within a receiving station of a machine for working elements in sheets.

Such a machine usually comprises an insertion station in which a stack of sheets is installed. The sheets are taken off successively from the top of this stack to be sent to a feed board. On this board, each sheet is placed in position before its traverse edge is gripped by a series of transporting pincers distributed along a transverse bar, also called a pincer bar. The ends of the pincer bar are secured to lateral drive chains. These transporting pincers drive the sheets through the various workstations of the machine. These workstations may in particular be a cutting station followed by a cutout ejection station, in order to culminate in a receiving station in which each sheet is released by the transporting pincers onto the top of a stack formed on a clearance pallet.

To ensure that the sheet falls uniformly, the sheet should be as flat as possible when stopped, at the moment of opening of the transporting pincers. Accordingly, the sheet is first held on its arrival in the station by a rear table and optionally by two side tables, which retract thereafter to allow the sheet to fall.

Because of the weakening of the sheets following the cutting and cutout ejection operations, the sheets no longer form anything more than fragile gratings of waste and because of the high speed at which these gratings arrive at the receiving station, slowing only by deceleration of the transverse pincer bar risks causing the rear portion of the grating to buckle and the rear portion tends to catch up with the front portion. This grating of waste must therefore be slowed by a matching device acting against its surface.

In patent CH 689 977 a device of this type has already been proposed comprising at least one flexible slowing member, consisting of a long brush extending transversely to the trajectory of the sheets and mounted so as to pivot about a transverse shaft, so that its trajectory about the shaft intersects the trajectory of the sheets. The direction of rotation of the end of the flexible slowing member intersects the trajectory of the sheets since it is opposed to the direction of movement of the latter. This device has driving means to cause the slowing means to pivot depending on the longitudinal dimension of the sheets and on their frequency of passage.

In this device, the movement of the slowing member is controlled by a rotary cam connected by a kinematic chain to the drive mechanism of the machine. This rotary cam acts on this slowing member by means of a horizontal runner with vertical movement, and the downstream portion of the runner has an upward oblique surface. Since the slowing member is mounted on a longitudinally movable frame, its movement remains constant for the sheets having a long longitudinal dimension, and then it reduces progressively as the frame advances facing the oblique portion of the horizontal runner.

With such a device, the movement of the slowing brush is optimal for one determined sheet format, to the detriment of the other formats. It is the passage of the pincer bar for transporting the sheets that determines the possibility of lowering the slowing brush. The kinematic connection between the control of descent of this brush and the drive mechanism of the machine forms a limitation to the accelerations communicated to the slowing brush.

Then another device of this type has been proposed in document EP 1 153 869, making it possible to respond to the problems posed by the previous system. In this device, the movements of the slowing member are generated by an electromechanical actuator connected to slaving means. This device gives total satisfaction, but it comprises costly elements which make its cost excessive for entry-level machines.

SUMMARY OF THE INVENTION

The object of the present invention is to propose a device suitable for the entry-level machines, while achieving performances close to those of the device with a slaved electric control described in document EP 1 153 869, while avoiding the disadvantages of the device described in document CH 689 977 with purely mechanical movement generation.

Accordingly, the subject of the present invention is a slowing device within a receiving station of a machine for working elements in sheets. A slowing device includes a flexible slowing member that extends transversely to the trajectory of sheets being fed. The member is movable between at least two limit positions, one in which its trajectory encounters that of the sheets, the other in which the slowing member is moved aside from the trajectory of the sheets. A drive device moves the slowing member between its limit positions. The drive device for the slowing member includes a pneumatic actuator which acts on a linear cam that pivots about a transverse shaft. A roller rolls along the surface of the linear cam. The roller and the slowing member are supported by a support that pivots about a transverse shaft.

The optimization of the slowing of the waste gratings is a key factor in making it possible to prevent clogging problems. To make it possible to remove the waste grating at high speed without clogging, the grating must be cleared away quickly, the next grating must pass over the grating being cleared away, the slowing brush must pinch the grating to slow it down and the grating must be released from the transporting pincers as soon as possible in order to be able to relax the pressure of the slowing brush so that the rear of the grating falls on the conveyor belt.

By virtue of the device that is the subject of the present invention, it is possible to satisfy these conditions for each different sheet format and at all production rates of the machine, while approaching the performance of the system with electrically regulated movement generation.

DESCRIPTION OF A PREFERRED EMBODIMENT

Figure 1:
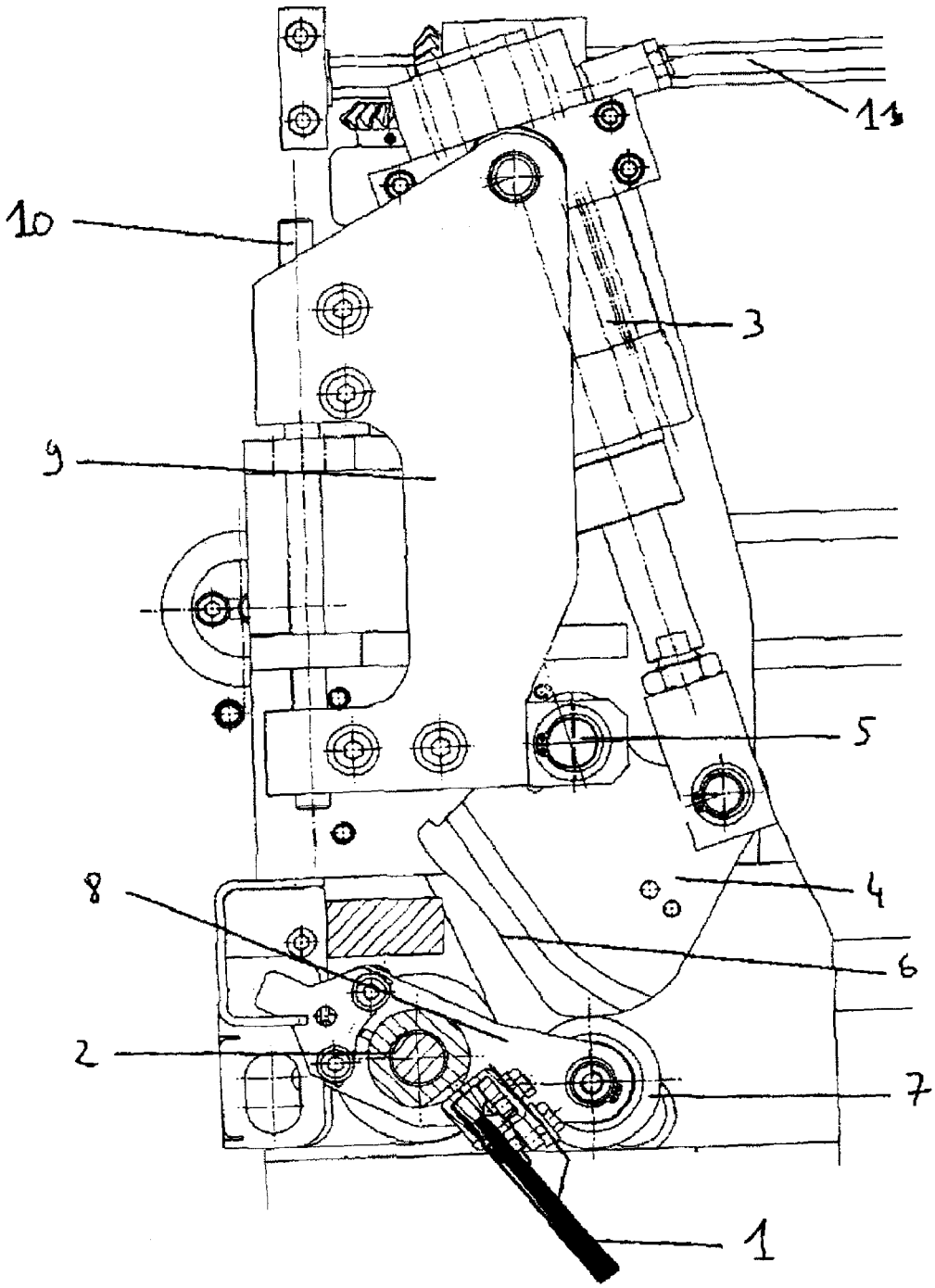
FIGS. 1 to 4 are side views of a slowing device according to the invention in various positions and with various adjustments of the slowing force.

For a better understanding of the following description, the words upstream and downstream are considered to relate to the direction of movement of the sheets: an upstream portion being oriented toward the entrance of the station on the left of FIGS. 1 to 4, while a downstream portion is oriented toward the right of these figures.

The sheets are therefore moved from left to right by transverse bars furnished with a plurality of pincers which hold the front edge of the sheets and pull them, in a manner just like that described in the existing devices and in particular that described in document EP 1 153 869. A slowing member 1, in this example a brush, is mounted so as to pivot about a transverse shaft 2 about which it is capable of moving between two limit positions illustrated in FIGS. 1 to 4. A pneumatic actuator 3, in this example a pneumatic cylinder, is used to drive this slowing member 1 in one direction or in the other about this transverse pivot shaft 2.

Although the example described relates to a slowing member 1 consisting of a brush, it is evident for those skilled in the art that this member could be formed by any appropriate slowing member.

A detector, not shown, is used to detect the passage of the pincer bar, in a manner identical to the detector 6 of the device described in document EP 1 153 869. The slowing brush 1 must be in the raised position to allow the transverse pincer bar to pass while it must be lowered to press each sheet against a bearing surface, as soon as the pincer bar has passed and the pincers have released the sheet.

The pneumatic cylinder 3 will be actuated by an electric control following the detection of the passage of the pincer bar. Since the speed of a pneumatic cylinder cannot be controlled and its movement is violent, a direct connection between the pneumatic cylinder 3 and the slowing member 1 would result in too violent an impact which could cause the rear of the sheet to rise, and it would not have the time to lower again before the passage of the next pincer bar. In addition, the impact could break certain fragile portions of the cut sheet.

It is for this reason that, in a slowing device according to the invention, the cylinder 3 acts on a linear cam 4 which pivots about a transverse shaft 5, and on the surface 6 of which a roller 7 is pressed. The roller 7 is supported by a support 8 pivoting about the transverse shaft 2. The slowing member 1 is also attached to the support 8.

When the cylinder 3 is actuated after the passage of a pincer bar, it acts on the linear cam 4 which pivots about the shaft 5, and causes the roller 7 to roll along its surface 6 thereby causing the support 8 and the slowing means 1 to pivot. The surface 6 of the cam 4 along which the roller 7 will roll makes it possible to modulate the speed of rotation of the slowing member 1 about the transverse shaft 2, and therefore to limit the violence of the impact of the slowing member 1 on the sheets.

Figure 2:
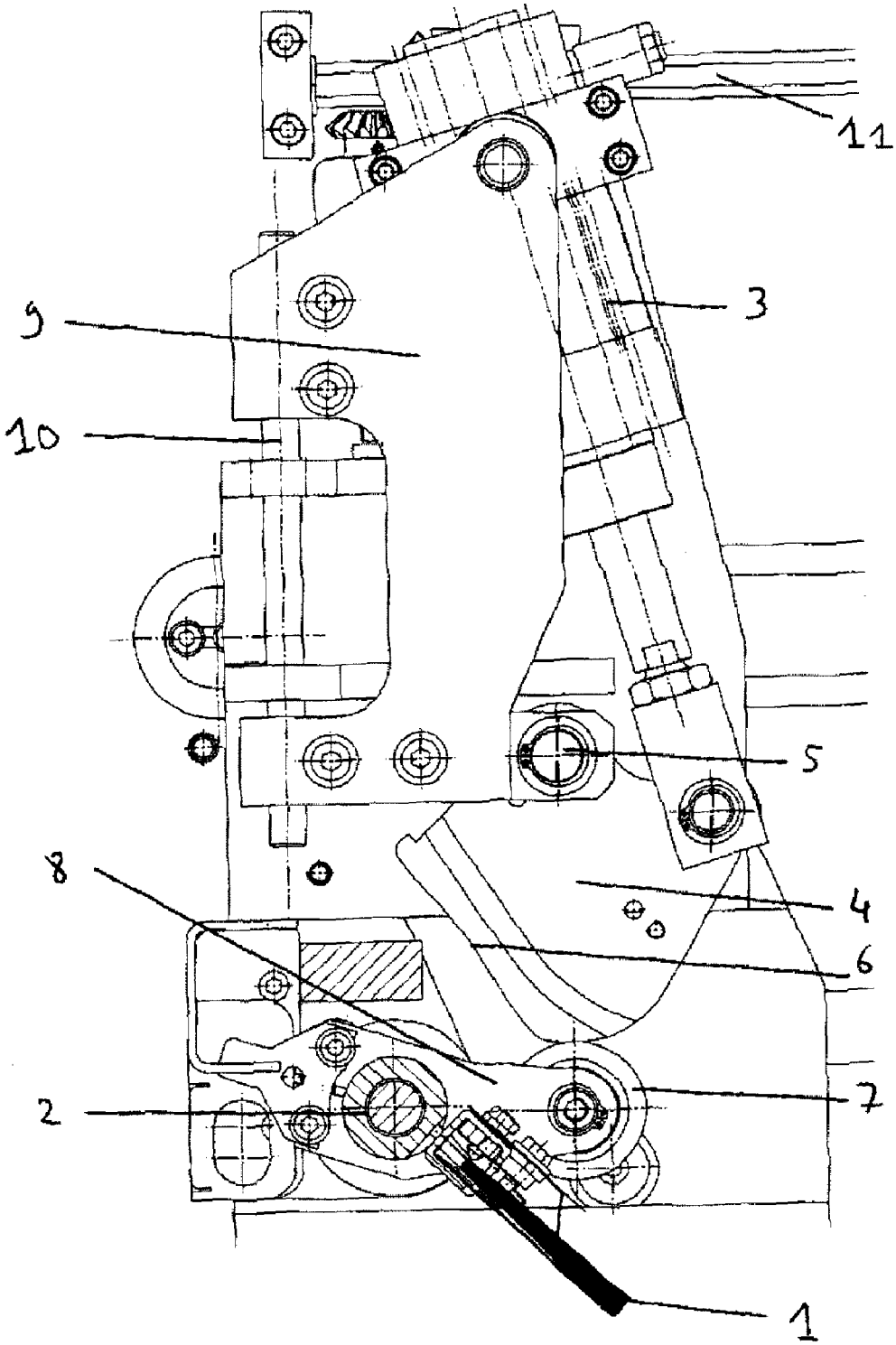
Figure 3:
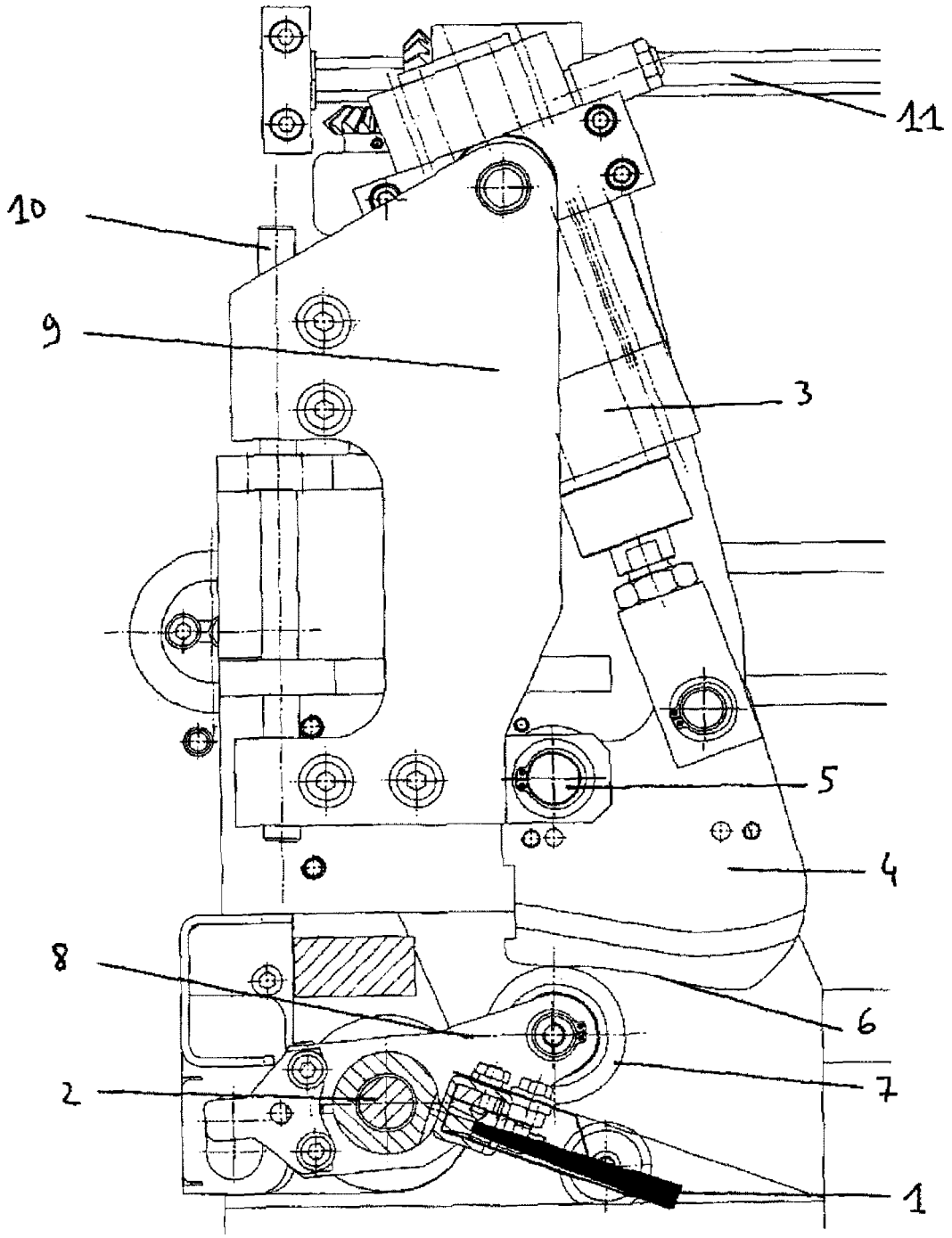
Figure 4:
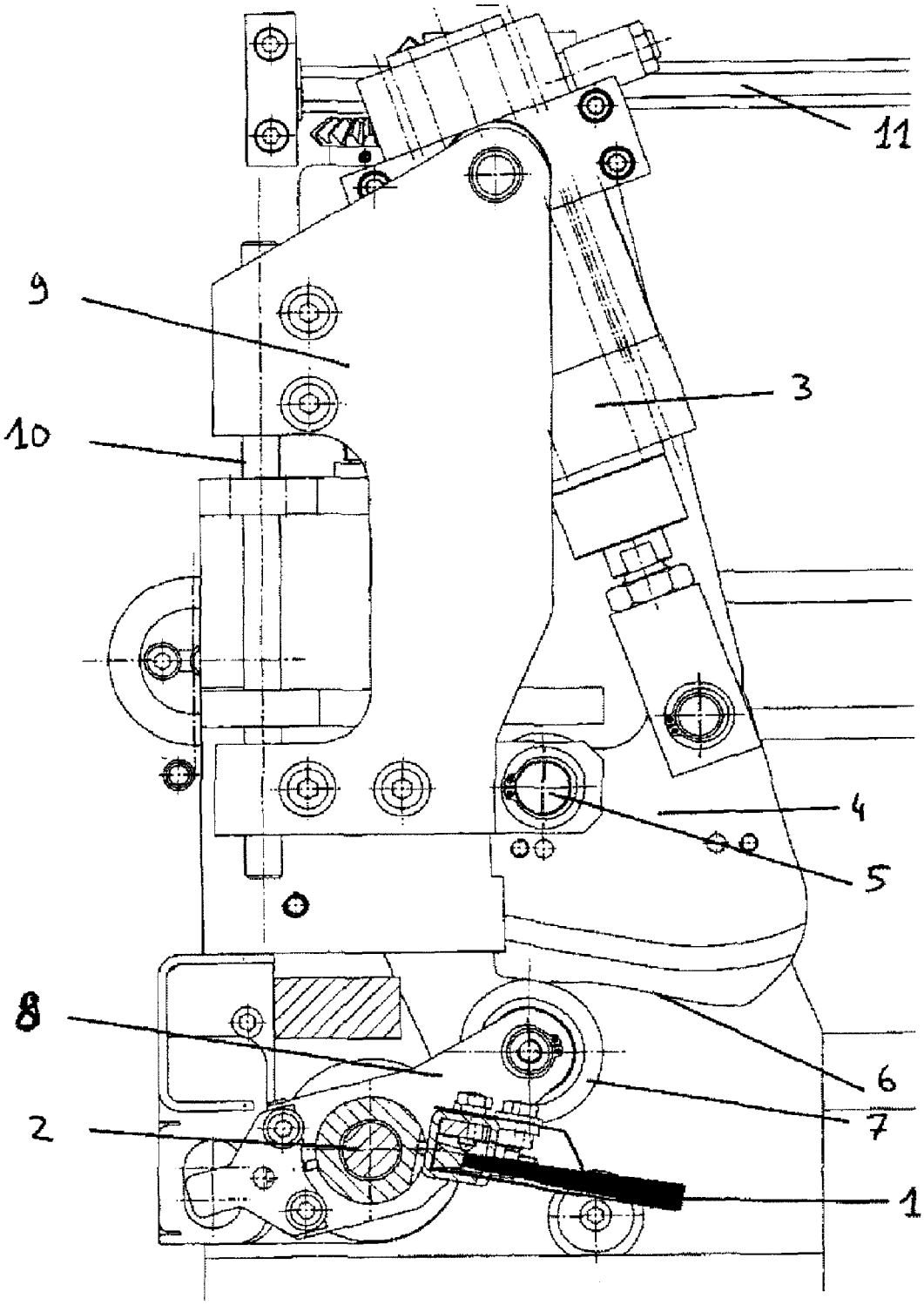

In FIGS. 1 and 2, the pneumatic cylinder 3 is retracted, and the slowing member 1 is raised so as to allow a pincer bar to pass. In FIGS. 3 and 4, the pneumatic cylinder 3 is fully extended, and the slowing member 1 is lowered so as to slow the sheet, once the latter is released by the pincers.

The device shown in FIGS. 1 to 4 also has several advantageous optional features. Therefore the pneumatic cylinder 3 and the linear cam 4 shown in FIGS. 1 to 4 are supported by a support 9. The support 9 may move in a sliding manner, along guide bars 10, in a direction substantially perpendicular to the plane of the sheets on which the slowing means 1 press. This feature makes it possible to carry out an adjustment of the slowing force exerted by the slowing member 1 on the sheets, by means of a mechanical control 11. Therefore FIGS. 1 and 3 represent the device adjusted so as to produce the maximum slowing force, while FIGS. 2 and 4 represent the device adjusted so as to produce the minimum slowing force.

Furthermore, a pneumatic cylinder produces impacts at the end of travel, that it is not desirable to propagate. Therefore, in order not to transmit these end-of-travel impacts into the mechanical chain, both ends of the surface 6 of the linear cam 4 have a constant radius relative to the transverse shaft 5 about which the cam 4 pivots.

Finally, the speed with which the sheets are released by the pincers depends on the production rate of the machine. When this production rate is low, the speed of the sheets is also low, and it is then advantageous to retard the slowing after the passage of the pincer bar compared with a higher production rate. The device according to the invention therefore optionally comprises means for retarding the actuation of the pneumatic cylinder (3) depending on the production rate of the working machine.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A slowing device within a receiving station of a machine for working elements in sheets, the slowing device comprising at least one slowing member extending transversely to a trajectory of the sheets to the receiving station, the slowing member being movable between at least two limit positions, one position in which its trajectory encounters that of the sheets and the other position in which the slowing member is moved aside from the trajectory of the sheets, a driving device operable for moving the slowing member between the limit positions, the driving device for the slowing member comprises a transverse shaft, a linear cam pivoting about the transverse shaft, a pneumatic actuator operable to pivot the linear cam, and a roller positioned and operable for rolling along a surface of the linear cam;

a support pivoting about a second transverse shaft, and the roller and the slowing member are supported by the support.

2. The device according to claim 1, further comprising a second support for the pneumatic actuator and the linear cam, the second support sliding along at least one guide bar in a direction substantially perpendicular to the trajectory of the sheets.

3. The device according to claim 1, wherein the cam surface includes ends which have a radius that is substantially constant relative to the transverse shaft.

* * * * *